US007328634B1

(12) United States Patent
Greenberg et al.

(10) Patent No.: US 7,328,634 B1
(45) Date of Patent: Feb. 12, 2008

(54) FLEX-HEAD SPEED WRENCH

(75) Inventors: Michael D. Greenberg, Bloomfield, CT (US); Keith E. Charette, Meriden, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 11/541,974

(22) Filed: Oct. 2, 2006

(51) Int. Cl.
*B25B 13/00* (2006.01)
*B25B 23/16* (2006.01)
*B25G 3/38* (2006.01)

(52) U.S. Cl. ..... 81/73; 81/177.7

(58) Field of Classification Search ..... 81/64, 81/73, 467, 63, 35, 177.7, 177.8
See application file for complete search history.

(56) References Cited

U.S. PATENT DOCUMENTS 1,431,389 A * 10/1922 Frisz ..... 81/177.7
1,537,657 A * 5/1925 Burch ..... 81/177.75
1,662,424 A * 3/1928 Judge ..... 81/177.75
1,673,761 A * 6/1928 Dowd ..... 81/57.5
1,713,527 A * 5/1929 Furst ..... 81/57.5
1,723,033 A * 8/1929 Hartley ..... 81/57.5
3,111,049 A * 11/1963 Brehmer ..... 81/57.26
3,276,295 A * 10/1966 Harper ..... 81/2
3,882,753 A * 5/1975 Svensen ..... 81/177.7
4,334,445 A * 6/1982 Timewell ..... 81/177.7
2005/0120836 A1 6/2005 Anderson
2007/0006689 A1* 1/2007 Carlson ..... 81/73

FOREIGN PATENT DOCUMENTS

FR 2565880 A1 * 12/1985

OTHER PUBLICATIONS

Speeder, Flex-Head, 17 ¼" Snap-On, Inc. (2006).

* cited by examiner

*Primary Examiner*—David B Thomas
(74) *Attorney, Agent, or Firm*—Bachman & LaPointe, P.C.

(57) ABSTRACT

A flex-head speed wrench has a head pivot axis transverse to an offset direction of the drive handle to enhance wrench stability.

21 Claims, 1 Drawing Sheet

FLEX-HEAD SPEED WRENCH

BACKGROUND OF THE INVENTION

The invention relates to speed wrenches. More particularly, the invention relates to flex-head speed wrenches.

A long-established art exists regarding speed wrenches. A basic speed wrench includes a single forging. The forging includes a square-section drive head at a first end for engaging a square drive socket compartment of a tool (e.g., a hex or twelve-point socket). A shaft of the wrench extends coaxially from the head. At an opposite second end, an end handle is coaxial with the head. A drive handle is radially displaced from the tool axis (e.g., parallel and spaced-apart) intermediate the head and end handle.

In speed handle operation, a socket is mounted to the head and then engaged to a fastener (e.g., a bolt or nut) to be either installed or removed. A user grasps the end handle with one hand and the drive handle with the other. The grasping of the end handle combined with the engagement of the socket to the fastener form an axis of rotation substantially coincident with the end handle axis. The drive handle and its connecting portions form a lever which the user rotates with his second hand in a circular orbit about the axis of rotation to install or remove the fastener. When used to remove a tight or stuck fastener, a breaker bar is typically used to break the fastener loose. The socket may then be transferred from the breaker bar to the speed wrench to complete the removal process.

Common variations include rotatably mounted handgrip sleeves at one or both handles. Other variations include an end knob at the end handle.

Another variation is a flex-head wrench as is found in breaker bars and similar drivers. This allows the speed wrench to be used as a breaker bar and avoids the need to transfer the socket after breaking the fastener loose. In such a flex-head wrench, the drive head is pivotally mounted to the shaft for rotation about a pivot axis normal to the common axis of the shaft end portions. In known constructions, the pivot axis is essentially coplanar with the offset of the intermediate handle. In this construction, pivoting of the drive head rotates its axis out of the plane of the offset. In breaker bar operation the head is rotated so that the drive axis is normal to the shaft axis. The head is rotated back so that the drive axis is coincident with the shaft axis for speed handle operation.

SUMMARY OF THE INVENTION

We have found stability problems with flex-head speed wrenches wherein the pivot axis is parallel to the direction of offset of the drive handle. Thus, one aspect of the invention involves a flex-head speed wrench wherein a pivot axis of the head is transverse to an offset direction of the drive handle.

Another aspect of the invention involves a method for reengineering a speed wrench from an initial configuration to a reengineered configuration. In the initial configuration, the pivot axis of the flex head is relatively parallel to a direction of offset of the drive handle. The reengineering rotates the pivot axis to be relatively transverse.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
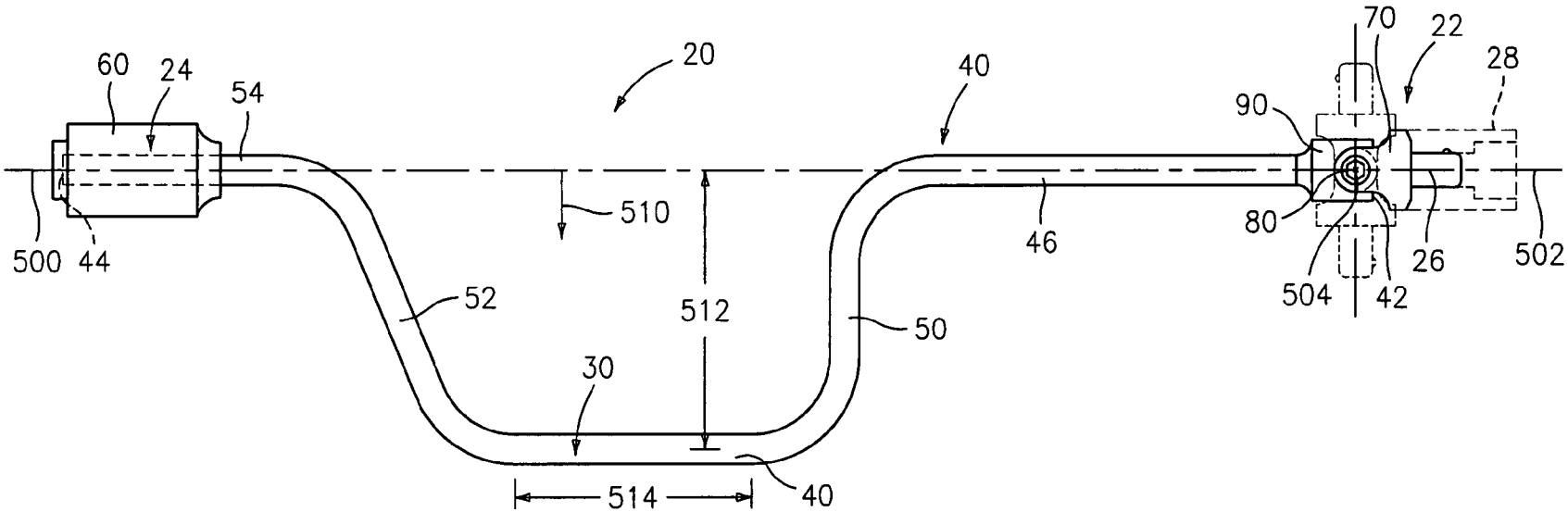
FIG. 1 is a plan view of a speed wrench.

FIG. 1 shows a flex-head speed wrench 20. The wrench has a flex head 22 at a first end of the wrench and an end handle 24 at a second end of the wrench. The end handle 24 has an axis 500. The flex head has a square drive head 26 with an insertion axis 502. The drive head may include a spring-loaded detent ball for engaging the socket 28. In the exemplary wrench, the drive head axis 502 is substantially coincident with the axis 500 when the flex head is in a neutral orientation (e.g., sufficiently close to allow the end handle to serve as a fulcrum during driving). As is discussed further below, the flex head has a single pivot axis 504 normal to the axes 500 and 502.

The speed wrench has a drive handle 30 offset from the axis 500 in a direction 510 and by a distance 512 which defines a sweep radius of the wrench (e.g., about 3.5 inches or, more broadly, 2.5-4.5 inches). The exemplary distance 512 is essentially constant along a length 514 of the drive handle 30. An exemplary overall end-to-end wrench length is about 17-20 inches or, more broadly, 15-25 inches.

The exemplary wrench includes a main/principal steel forging 40. The forging 40 extends from a first end 42 at the flex head to a second end 44 at the end handle 24. The exemplary forging 40 includes a straight shank 46 essentially coincident with the axis 500 (e.g., effective to permit the end handle to serve as a fulcrum during driving). The forging 40 includes a portion 48 forming the exemplary drive handle 30 and connecting portions 50 and 52 providing the handle offset at first and second ends of the drive handle. The exemplary forging 40 includes a short transition 54 to a portion along the end handle 24. The exemplary end handle 24 includes a grip sleeve 60 rotatably mounted (e.g., via bearings not shown) to the forging. In alternative implementations, this grip sleeve may be omitted. In yet other alternative implementations, a grip sleeve may be provided on the drive handle 30.

Figure 2:
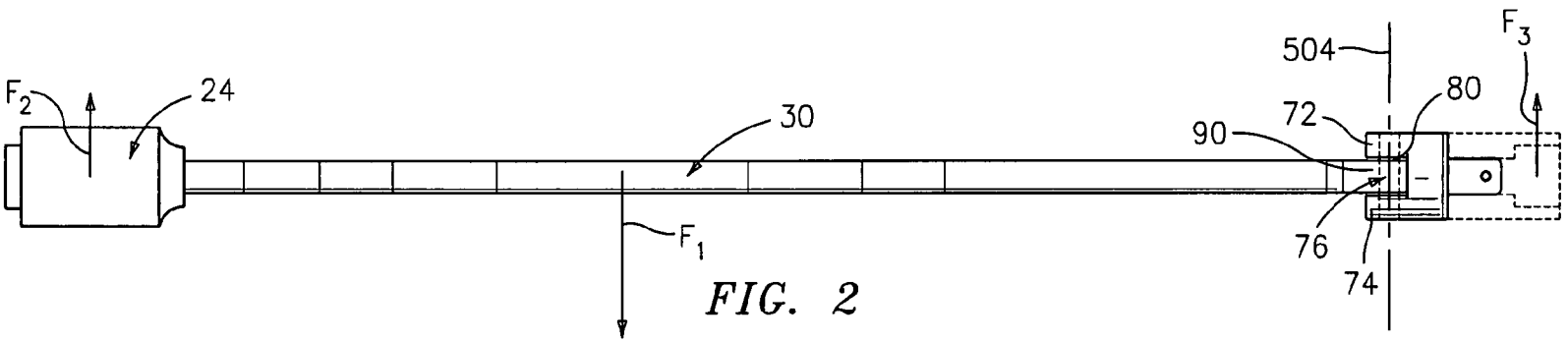
FIG. 2 is a side view of the wrench of FIG. 1

The exemplary flex head 22 includes a second steel forging which includes the drive head 26 and a clevis 70. The exemplary clevis 70 has first and second arms 72 and 74 (FIG. 2) with a gap 76 therebetween. A pin 80 may have end portions mounted in associated holes in the arms 72 and 74 (e.g., via an interference fit or threaded engagement with at least one of the arms). A central portion of the pin 80 passes through an associated aperture in a first end portion 90 of the main forging 40 shank 46. The pin 80 serves as an axle so that an axis of the pin and the associated hole in the shank forms the pivot axis 504.

The flex head 22 may be pivoted through a range of orientations. An exemplary range is approximately 180° between first and second extremes (shown in broken lines in FIG. 1) each 90° from a neutral orientation (shown in solid line). A ball detent, pawl detent, or the like may be provided between the clevis and shank end to detent the flex head in the illustrated and/or intermediate orientations. An on-center biasing spring or a friction coupling may alternatively or additionally be provided. Typically, the first extreme with the drive head pointing opposite the handle offset direction will be used in breaker bar operation. The neutral orientation will then be used for speed handle operation.

According to the present invention, the pivot axis 504 is not parallel to the offset direction 510. With a planar offset, the axis 504 is thus not in the plane of offset (e.g., a plane common to the handles and shank). The exemplary pivot axis 504 is essentially normal to the offset direction (e.g., within 10° of normal).

In an exemplary loosening operation with the wrench in the illustrated orientation, a force $F_1$ normal to the offset direction 510 is applied by the user's drive hand to the drive handle 30. An oppositely-directed force $F_2$ is applied by the user's fulcrum hand to the end handle 24. However, because the drive handle 30 and end handle 24 and their associated forces are different distances from the flex head 22, the fastener or workpiece must exert a force $F_3$ opposite the direction of the force $F_1$. With the exemplary pivot axis orientation, the force $F_3$ may easily be transmitted across the flex head. If the axis 504 were in the plane of offset, there would be articulation of the head causing instability and associated socket and/or fastener wear or damage. This instability may include wobble and/or disengagement. Thus, the present head will tend to remain in the neutral orientation for proper speed handle operation.

Although the exemplary flex head places the clevis on the head rather than on the shank, the reverse is also possible. In general, with the clevis on the head, it may be easier to limit the thickness of the flex head. The transverse operational envelope of the flex head may be reduced because articulations of the head will not displace the clevis from the drive head axis 502. Accordingly, in an exemplary embodiment, a width of the gap between the clevis arms may be kept low to limit thickness. An exemplary gap is approximately the same as the nominal size of the drive head (e.g., 90-120% or 100-110%). An overall transverse dimension (e.g., a diameter of the clevis) is an exemplary 150-200% of the drive head nominal size. An exemplary drive head nominal size is selected from the common standard English sizes with particular relevance to ⅜ inch and ½ inch drive.

Various components of an exemplary wrench (e.g., the main forging and the flex head forging other than the drive head) may have a chrome finish over a steel substrate for typical applications. However, a black oxide finish may be appropriate for aerospace use in order to minimize chances of chrome debris contaminating the work environment.

One or more embodiments of the present invention have been described. Nevertheless, it will be understood that various modifications may be made without departing from the spirit and scope of the invention. For example, when applied in the reengineering of an existing wrench configuration, details of the existing configuration can influence details of the particular implementation. Accordingly, other embodiments are within the scope of the following claims.

What is claimed is:

1. A speed wrench comprising:

a flex head having a single pivot axis, permitting pivoting between a neutral orientation and a breaker bar orientation;

an end handle; and a drive handle rigidly and un-articulatedly coupled to the end handle, wherein:

said single pivot axis of the flex head is substantially transverse to an offset direction of the drive handle.

2. The speed wrench of claim 1 wherein:

the wrench includes a main forging;

the flex head includes:

an essentially square sectioned head and a clevis unitarily formed with or fixedly attached to each other; and a pin extending through arms of the clevis and an end portion of the main forging between the arms.

3. The speed wrench of claim 2 wherein:

the end portion has a thickness along/adjacent the pin axis of no more than 110% of a drive size of the head.

4. The speed wrench of claim 2 wherein:

the clevis has a thickness orthogonal to an axis of the head of no more than 200% of a drive size of the bead.

5. The speed wrench of claim 1 wherein:

the pivot axis is within 10° of normal to said offset direction.

6. The speed wrench of claim 1 wherein:

the end handle includes a grip rotatably mounted to a forging of the speed wrench.

7. The speed wrench of claim 1 wherein:

the drive handle and the end handle are along a first forging of the speed wrench.

8. The speed wrench of claim 1 wherein:

the drive handle is offset by 2.54.5 inch relative to a drive axis of the speed wrench.

9. A method for reengineering a speed wrench configuration from a baseline configuration to a reengineered configuration comprising:

rotating a fixed pivot axis of a flex head from a first orientation to a second orientation, the first orientation being closer to parallel to a handle offset direction than transverse and the second orientation being closer to transverse than to parallel.

10. The method of claim 9 further comprising:

switching a clevis of the flex head from a wrench shaft to a head forging.

11. A speed wrench comprising a flex head;

an end handle;

a drive handle offset from a drive axis; and means for limiting wobble of the flex head resulting from a force couple from user engagement of the end handle and drive handle.

12. The speed wrench of claim 11 wherein:

the end handle has a grip mounted for rotation about an axis essentially coincident with the drive axis.

13. A method for using the wrench of claim 1 comprising:

attaching a socket to the flex head;

engaging the socket to a fastener;

grasping the end handle with a first hand on;

grasping the drive handle with a second hand; and applying a force couple with the first and second hands.

14. The method of claim 13 wherein:

the applying a force couple comprises holding the end handle steady while orbiting the drive handle.

15. The speed wrench of claim 1 wherein:

the end handle has a rotatably mounted grip sleeve.

16. The speed wrench of claim 15 wherein:

a single main piece extends from a first portion at the flex head to a second portion to which the grip sleeve is mounted.

17. A speed wrench comprising:

a single main forging extending from a first end to a second end and having:

a shank and an end handle, the shank and end handle substantially coincident with a drive axis;

a drive handle; and portions connecting the drive handle to the shank and the end handle to offset the drive handle from the drive axis; and a drive head coupled to a first end portion of the forging for rotation about a single pivot axis, the single pivot axis being within 10° of transverse to an offset direction of the drive handle.

18. The speed wrench of claim 17 wherein:

the drive head is unitarily formed with or fixedly attached to a clevis.

19. The speed wrench of claim 18 wherein the clevis and drive head are of a second forging.

20. The speed wrench of claim 17 wherein the end handle portion carries a rotatably mounted grip sleeve.

21. The speed wrench of claim 1 wherein:

the flex head includes:

an essentially square sectioned head mounted for fixed pivoting about the pivot axis.

* * * * *

UNITED STATES PATENT AND TRADEMARK OFFICE

CERTIFICATE OF CORRECTION

PATENT NO. : 7,328,634 B1
APPLICATION NO. : 11/541974
DATED : February 12, 2008
INVENTOR(S) : Michael D. Greenberg et al.

It is certified that error appears in the above-identified patent and that said Letters Patent is hereby corrected as shown below:

Column 4, claim 4, line 8, “bead” should read --head--.

Column 4, claim 8, line 19, “2.54.5” should read --2.5-4.5--.

Column 4, claim 11, line 32, “comprising” should read --comprising:--.

Signed and Sealed this

Seventeenth Day of June, 2008

JON W. DUDAS
*Director of the United States Patent and Trademark Office*